US012352132B2

(12) United States Patent
Fould et al.

(10) Patent No.: US 12,352,132 B2
(45) Date of Patent: Jul. 8, 2025

(54) SYSTEMS AND METHODS FOR MULTILATERAL COMPLETIONS

(71) Applicant: Schlumberger Technology Corporation

(72) Inventors: Jeremie Fould, Al Khobar (SA); Mahmoud Seiam, Dhahran (SA); Salim Zeggagh, Dhahran (SA); Mike Rea, Dhahran (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/698,836

(22) PCT Filed: Oct. 21, 2022

(86) PCT No.: PCT/US2022/047443

§ 371 (c)(1),
(2) Date: Apr. 5, 2024

(87) PCT Pub. No.: WO2023/081026

PCT Pub. Date: May 11, 2023

(65) Prior Publication Data

US 2024/0410254 A1 Dec. 12, 2024

Related U.S. Application Data

(60) Provisional application No. 63/275,744, filed on Nov. 4, 2021.

(51) Int. Cl.
*E21B 41/00* (2006.01)
*E21B 7/06* (2006.01)
(Continued)

(52) U.S. Cl.
CPC ..... *E21B 41/0035* (2013.01); *E21B 7/061* (2013.01); *E21B 23/01* (2013.01); *E21B 29/06* (2013.01); *E21B 33/13* (2013.01)

(58) Field of Classification Search
CPC ..... E21B 29/06; E21B 23/01; E21B 7/061; E21B 41/0035
See application file for complete search history.

(56) References Cited

U.S. PATENT DOCUMENTS 8,286,708 B2 10/2012 Assal et al.
9,151,127 B1 * 10/2015 Branton ..... E21B 23/01
(Continued)

FOREIGN PATENT DOCUMENTS

WO 2019221818 A1 11/2019

OTHER PUBLICATIONS

International Search Report and Written Opinion issued in PCT/US2022/047433 on Feb. 117, 2023.

*Primary Examiner* — Robert E Fuller
*Assistant Examiner* — Lamia Quaim
(74) *Attorney, Agent, or Firm* — Jeffrey D. Frantz

(57) ABSTRACT

A technique facilitates production of desired well fluids from a lateral wellbore or wellbores. Aspects of the technique comprise drilling and completing the main wellbore which may include a lower lateral wellbore portion. A production deflector may be run downhole into the main wellbore, and then a lateral wellbore section, e.g. an upper lateral wellbore section, may be drilled from the main wellbore. A liner may then be run downhole and out into the lateral wellbore section. The liner comprises a scab portion which ends up disposed across the main wellbore. Subsequently, the scab portion is removed, e.g. milled, to enable communication with both the lateral wellbore section and the main wellbore extending below the lateral wellbore section.

20 Claims, 15 Drawing Sheets

(51) Int. Cl.

| | |
|---|---|
| ***E21B 23/01*** | (2006.01) |
| ***E21B 29/06*** | (2006.01) |
| *E21B 33/13* | (2006.01) |

(56) References Cited

U.S. PATENT DOCUMENTS

| | | | | |
|---|---|---|---|---|
| 2005/0257930 | A1 | 11/2005 | Carter, Jr. | |
| 2014/0102710 | A1 | 4/2014 | Benson et al. | |
| 2015/0369022 | A1* | 12/2015 | Zhou | E21B 7/061 166/50 |
| 2016/0047176 | A1 | 2/2016 | Martin | |
| 2017/0234113 | A1* | 8/2017 | Steele | E21B 17/026 166/381 |
| 2018/0266211 | A1* | 9/2018 | Modeland | E21B 43/14 |
| 2018/0274300 | A1* | 9/2018 | Vemuri | E21B 43/14 |
| 2021/0404294 | A1* | 12/2021 | Larsen | E21B 43/305 |

* cited by examiner

SYSTEMS AND METHODS FOR MULTILATERAL COMPLETIONS

CROSS-REFERENCE TO RELATED APPLICATION

The present document is a National Stage Entry of International Application No. PCT/US2022/047443, filed Oct. 21, 2022, which is based on and claims priority to U.S. Provisional Application Ser. No. 63/275,744, filed Nov. 4, 2021, which is incorporated herein by reference in its entirety.

BACKGROUND

Hydrocarbon fluids such as oil and natural gas are obtained from a subterranean geologic formation, referred to as a reservoir, by drilling a wellbore that penetrates the hydrocarbon-bearing formation. Under certain circumstances, one or more main wellbores are drilled with one or more lateral wellbores branching off from the main wellbores to access various parts in the reservoir. Once the wellbores are drilled, various forms of well completion components may be installed to control and enhance the efficiency of producing the various fluids from the reservoir.

SUMMARY

In general, a methodology and system are provided for facilitating production of desired well fluids from a lateral wellbore or wellbores. According to an embodiment, aspects of the methodology comprise drilling and completing the main wellbore which may include a lower lateral wellbore portion. A production deflector may be run downhole into the main wellbore, and then a lateral wellbore section, e.g. an upper lateral wellbore section, may be drilled from the main wellbore. A liner may then be run downhole and out into the lateral wellbore section. The liner comprises a scab portion which ends up disposed across the main wellbore. This scab portion may be oriented at an angle with respect to the direction of the main wellbore. Subsequently, the scab portion is removed, e.g. milled, to enable communication with both the lateral wellbore section and the main wellbore extending below the lateral wellbore section.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible. This description is not to be taken in a limiting sense, but rather for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

The disclosure herein generally involves a methodology and system to facilitate completing a multilateral well with drill through capability. The system may comprise an anchor, a production deflector, and a liner utilizing a removable scab liner. The scab liner may be used to re-establish the continuity and integrity of the lateral liner during the drill through operation. In embodiments, the through tubing re-entry capability may be added once the junction is set and the anchor and production deflector are set in the well. The system or method of the current disclosure may be implemented in newly drilled wells as well as re-entry wells and is stackable for two or more lateral legs (lateral wellbore sections) to provide accessibility in all the legs where proper completion equipment is used.

Figure 1:
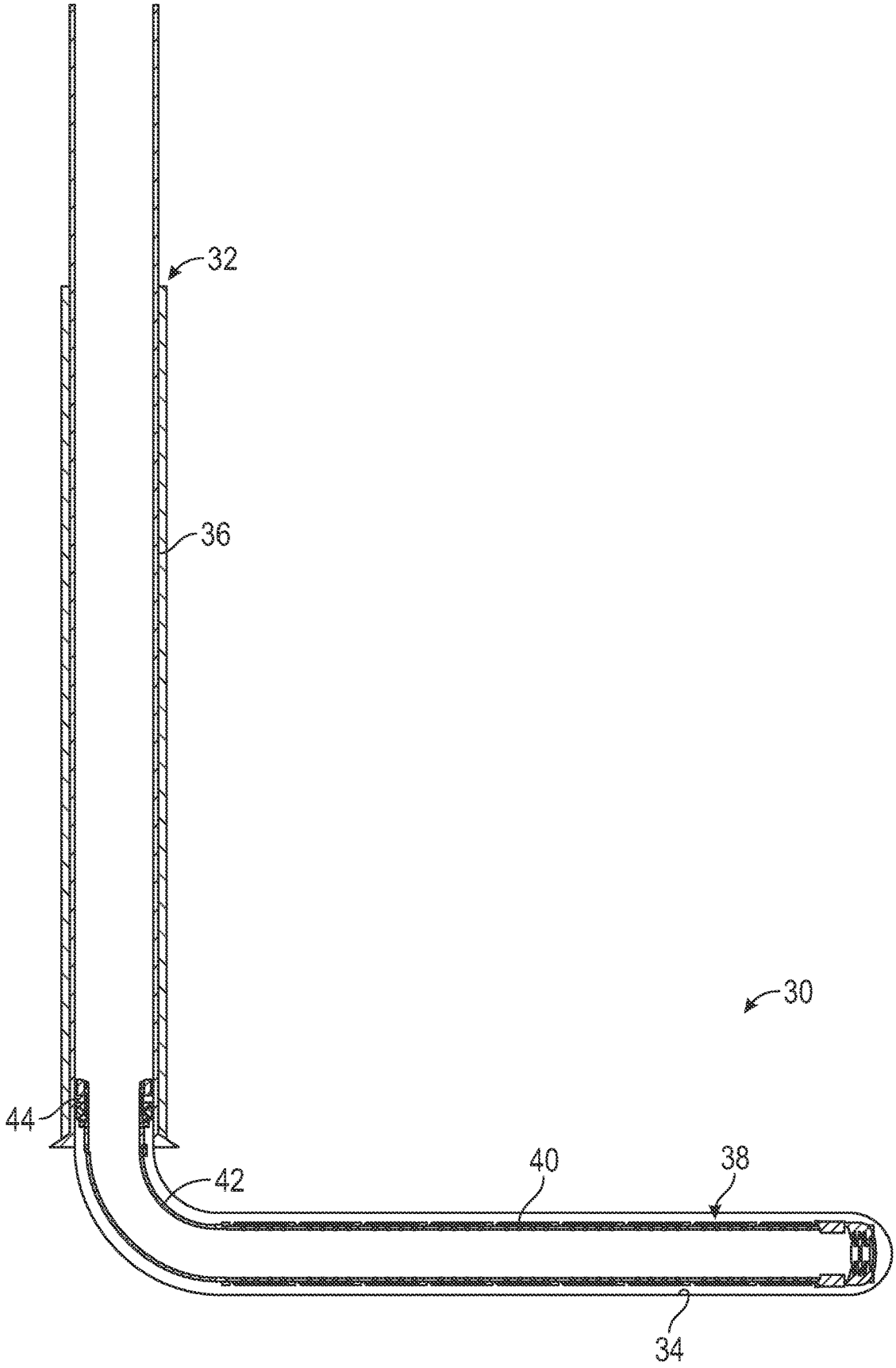
FIG. 1 is an illustration of an example of a well having a main wellbore which has been completed, according to an embodiment of the disclosure.

Referring generally to FIG. 1, an example of a well 30 is illustrated as having a main wellbore 32 which may include a lower lateral section 34, e.g. a lower lateral wellbore leg. The main wellbore 32 is initially drilled and then a vertical section of the main wellbore 32 is lined with a casing 36. Subsequently, the main wellbore 32 may be completed by deploying a completion 38 into the lower lateral section 34. By way of example, the completion 38 may comprise a sandface completion 40 connected with a tubular section 42 that extends to a packer 44 disposed in sealing engagement with a lower interior surface of the casing 36.

Figure 2:
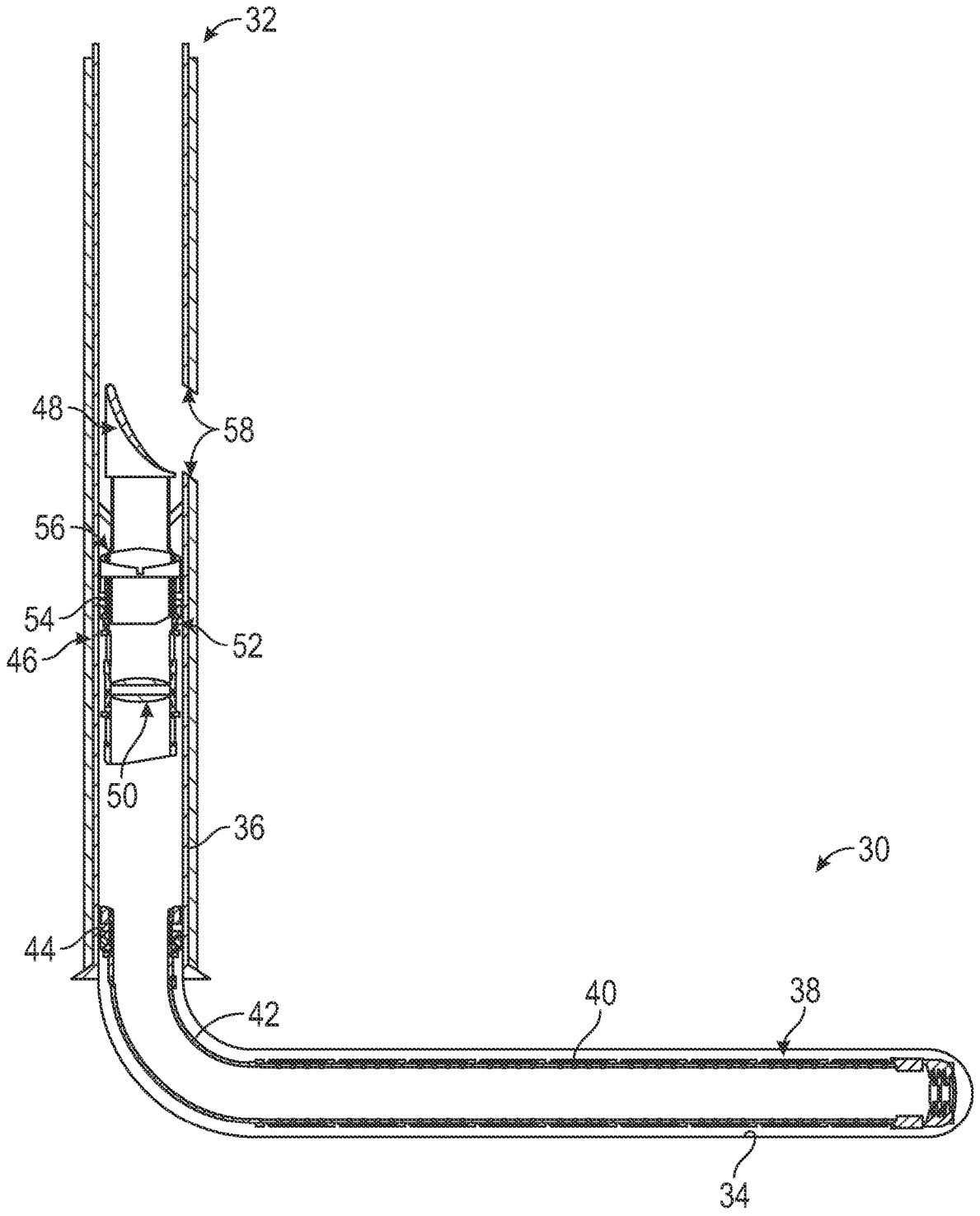
FIG. 2 is an illustration of an example of the well with an anchor and whipstock run into the main wellbore in one trip, according to an embodiment of the disclosure.
Figure 3:
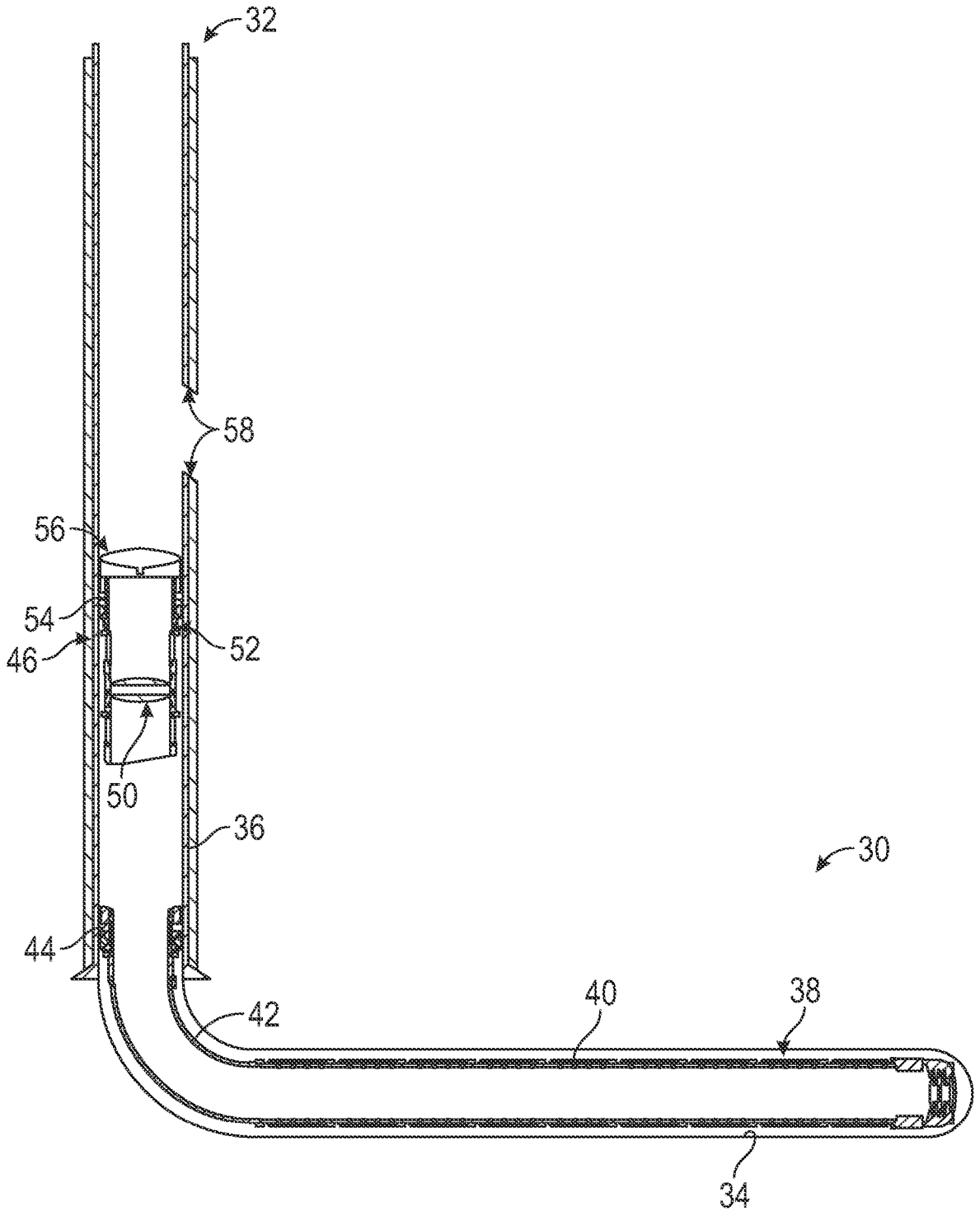
FIG. 3 is an illustration of an example of the well in which the whipstock has been pulled after cutting a lateral window, according to an embodiment of the disclosure.

After deploying the completion 38, an anchor 46 and a whipstock 48 are run down hole in a single trip and deployed at a desired location along the interior of casing 36, as illustrated in FIG. 2. In some embodiments, the components may be run downhole in separate trips. According to an example, the anchor 46 may comprise a removable disk 50, e.g. a ceramic disk, a hanger 52, a packer 54, and a tieback receptacle 56. After positioning the anchor 46 and the whipstock 48, a lateral window 58 may be cut, e.g. milled, through the wall forming casing 36 with the aid of whipstock 48. Once the lateral window 58 is formed, the whipstock 48 may be pulled out of hole, as illustrated in FIG. 3. The whipstock 48 may be pulled using a hook and measurement-while-drilling system or via other suitable methods.

Figure 4:
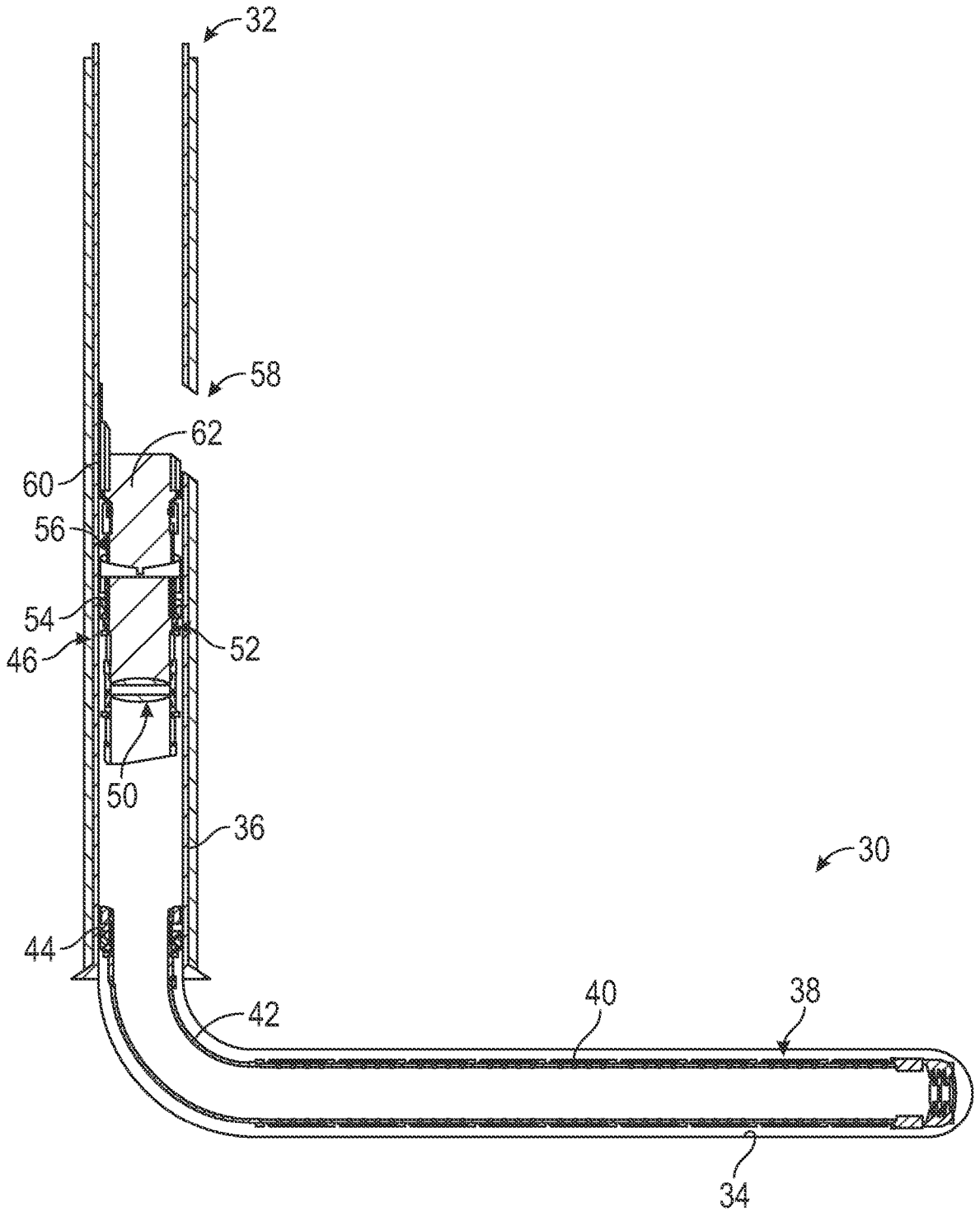
FIG. 4 is an illustration of an example of the well in which a drilling and production deflector has been deployed proximate the lateral window, according to an embodiment of the disclosure.

According to an embodiment of the methodology, a drilling and production deflector (DPD) 60 is subsequently run downhole and joined with anchor 46, as illustrated in FIG. 4. In some embodiments, a sand plug 62 may be deployed downhole above the disk 50 to act as a debris barrier. In other embodiments, viscous fluids or other suitable materials may be used in place of sand plug 62 to serve as the desired debris barrier. Although specific elements of the methodology may vary, one example comprises: circulating fluid to clean an inside diameter of packer 54; confirming landing and orientation of the DPD 60; releasing the running tool used to run the DPD 60 downhole; and deploying the sand plug 62 as illustrated.

Figure 5:
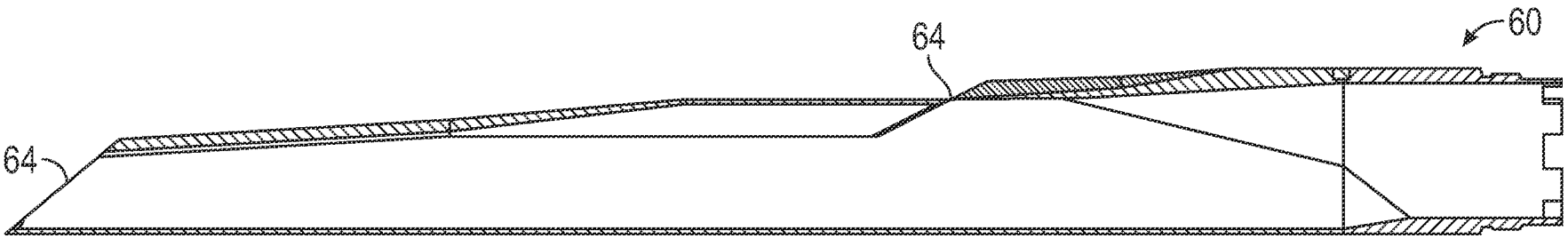
FIG. 5 is an illustration of an example of a drilling and production deflector, according to an embodiment of the disclosure.

The DPD 60 may be installed to help deflect a drill bit used for drilling a lateral wellbore section through lateral window 58, as described in greater detail below. It should be noted that in some embodiments, a flapper valve may be positioned in conjunction with the DPD 60 at a location which reduces debris accumulation during drilling operations. Additionally, the DPD 60 may be used to help deflect a subsequently deployed liner into the lateral wellbore. An example of one type of DPD 60 is illustrated in FIG. 5 and shows a variety of curved surfaces 64 selected so as to guide the drill bit and/or liner along a suitable curvature. The DPD 60 may be formed of a plurality of components which are welded together or otherwise secured together to create the desired length, width, and curvature of surfaces 64.

Figure 6:
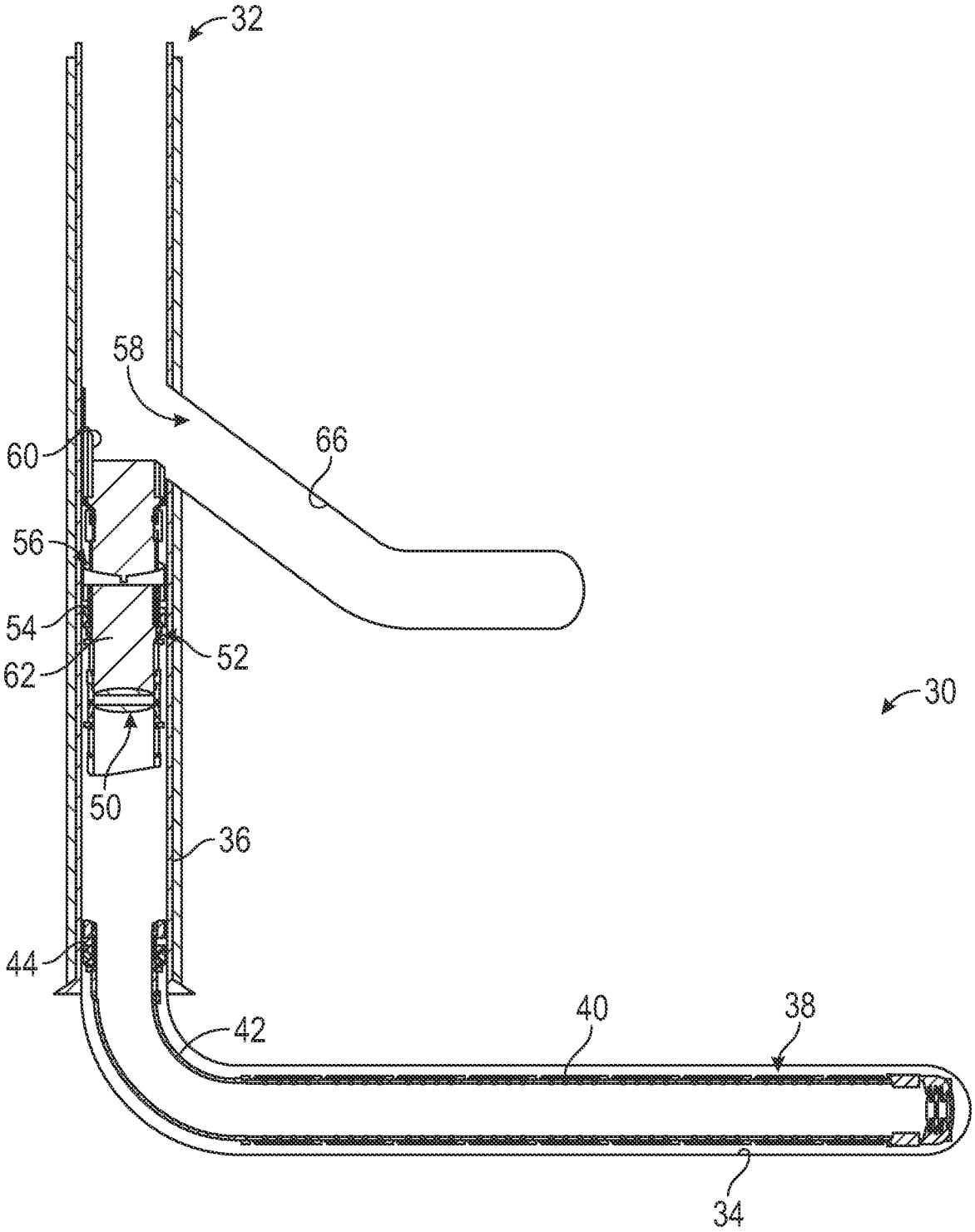
FIG. 6 is an illustration of an example of the well in which a lateral section of the well has been drilled through the lateral window, according to an embodiment of the disclosure.

As illustrated in FIG. 6, once the DPD 60 is properly located and oriented, a lateral section 66 may be drilled by guiding a suitable drill bit through the lateral window 58 via the DPD 60. In some applications, the inside diameter of DPD 60 may be protected with sand during drilling activities. It should be noted the size of DPD 60 may be adjusted according to the diameter of the drill bit used for drilling lateral wellbore section 66.

Figure 7:
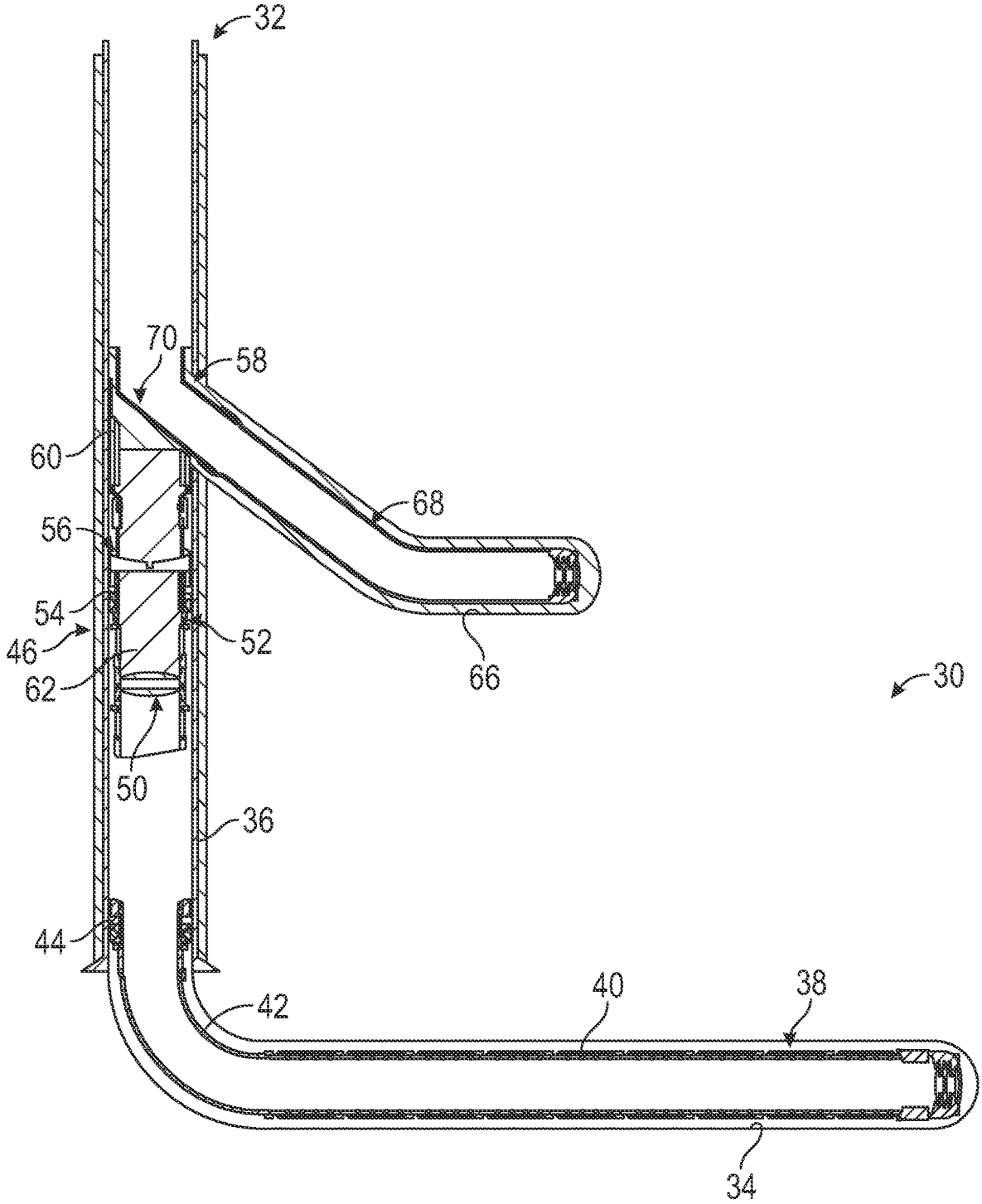
FIG. 7 is an illustration of an example of the well in which a liner has been run down the main wellbore and out into the lateral section, according to an embodiment of the disclosure.

Subsequently, a liner 68 is run down through main wellbore 32, guided out through lateral window 58 via DPD 60, and deployed into lateral wellbore section 66, as illustrated in FIG. 7. In some embodiments, the main wellbore 32 may have cement and the cement may be overdisplaced. Once the liner 68 is properly deployed in the lateral section 66, the liner running tool may be released and retrieved. The liner 68 may then be cemented and the lateral window 58 may be cleaned out. In the illustrated embodiment, the liner 68 comprises a scab portion 70 which may be a separate section of liner 68 or integrally formed with liner 68. As illustrated, scab portion 70 is disposed across the vertical portion of main wellbore 32 and oriented at an angle with respect to the axial direction of the vertical portion of main wellbore 32.

Figure 8:
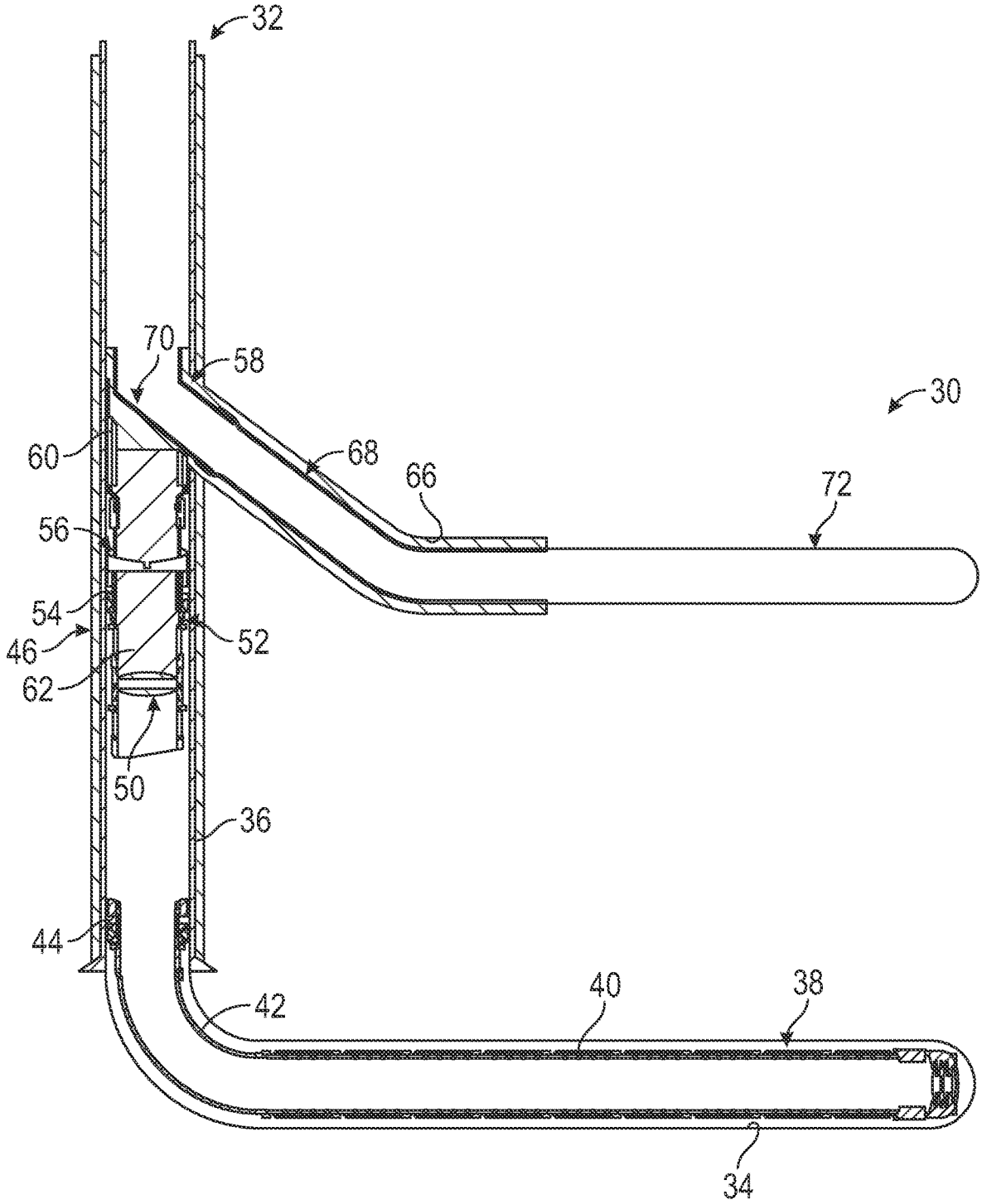
FIG. 8 is an illustration of an example of the well in which an extended lateral reservoir section has been drilled, according to an embodiment of the disclosure.
Figure 9:
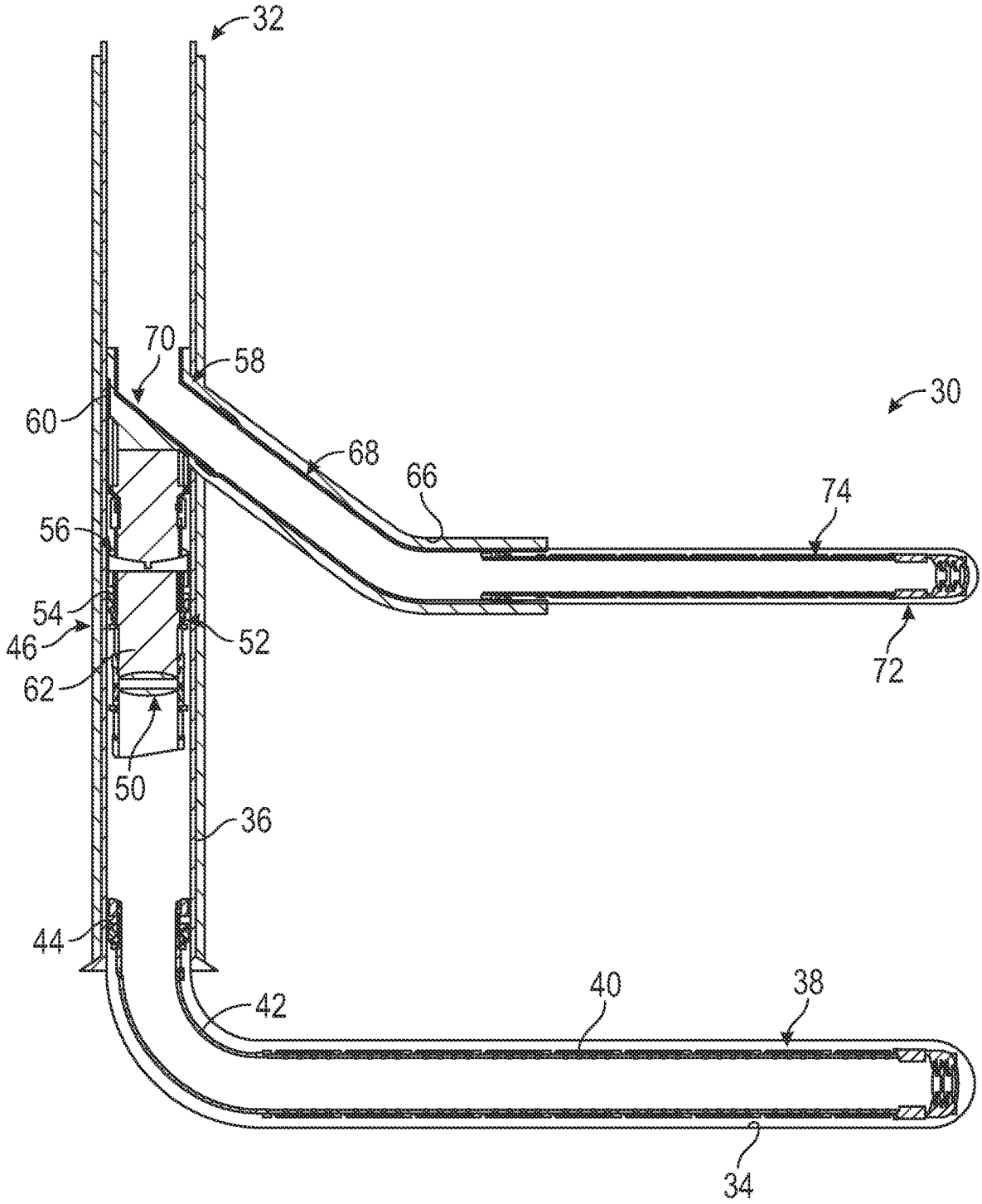
FIG. 9 is an illustration of an example of the well in which a completion, e.g. a sandface completion, has been deployed in the lateral reservoir section, according to an embodiment of the disclosure.

As illustrated in FIG. 8, the lateral section 66 may be extended by additional drilling to form an extended portion 72. For example, a drilling tool may be moved downhole and through an interior of liner 68 to enable drilling of the extended portion 72 of lateral wellbore section 66. The extended portion 72 may be sized to receive a suitable lateral completion 74, e.g. a lateral sandface completion, as illustrated in FIG. 9.

The scab portion 70 of liner 68 is constructed to enable removal so as to ultimately facilitate production from both the lower lateral section 34 of main wellbore 32 and from the relatively upper lateral section 66. By way of example, the scab portion 70 may be formed as a separable component which may be latched onto and retrieved to the surface by a suitable tool. In other embodiments, the scab portion 70 may be formed to facilitate cutting away, e.g. milling, of the material for communication with the main wellbore 32 located below lateral section 66.

Figure 10:
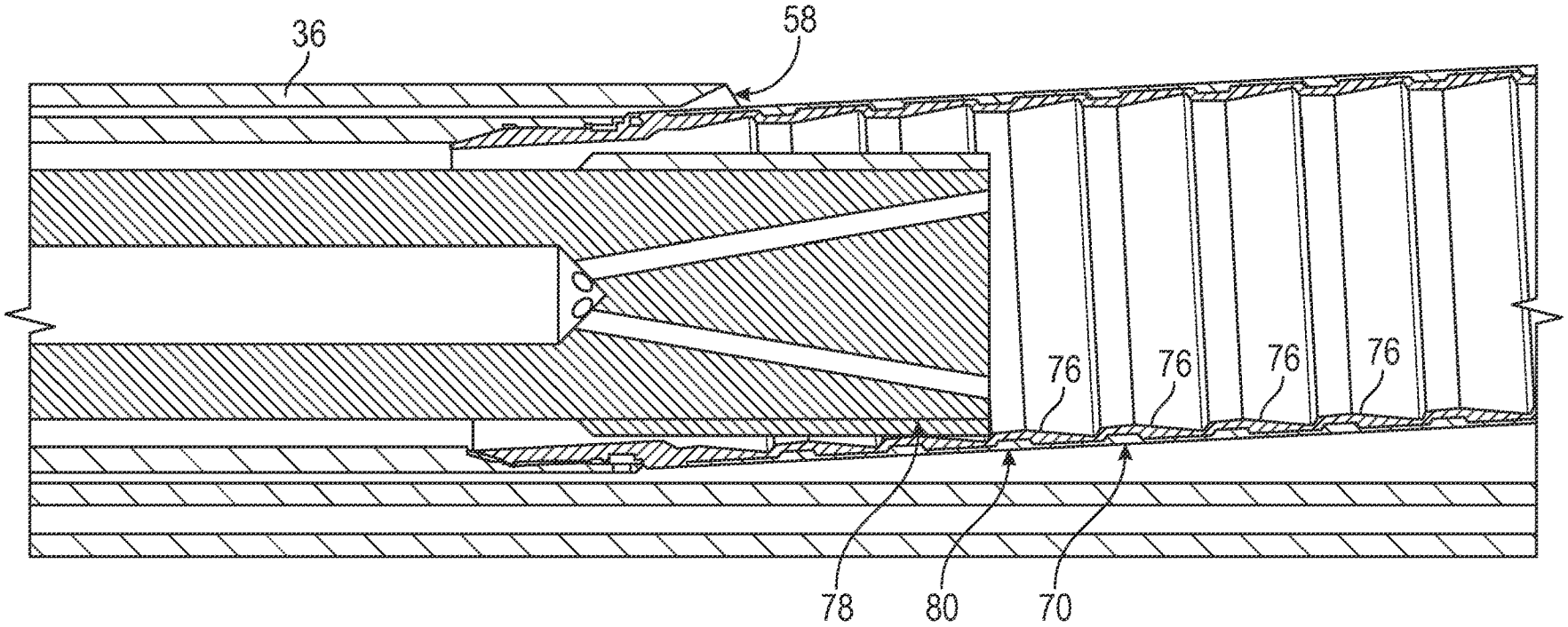
FIG. 10 is an illustration of an example of a scab portion of the liner prior to removal, according to an embodiment of the disclosure.

For example, the scab portion 70 may be formed from a composite material which is readily milled by a suitable milling tool. Additionally, the scab portion 70 may be formed with internal ridges 76, as illustrated in FIG. 10. The internal ridges 76 are sized and oriented to engage, i.e. catch, an edge of a milling bit 78 (or other suitable cutting tool) so as to help prevent the milling bit 78 from sliding along the interior of scab portion 70. In other words, the internal ridges 76 are oriented to catch the milling bit 78 so that it can immediately begin to cut through the wall of scab portion 70 even though scab portion 70 is oriented at an angle with respect to the linear direction of movement of milling bit 78. Once the milling bit 78 engages a corresponding internal ridge 76, the internal ridge 76 effectively establishes a starting point for the milling operation. The ability to "catch" the milling bit 78 to ensure desired cutting through the angled scab portion 70 enables construction of scab portion 70 from a variety of materials including steel materials.

In some embodiments, the scab portion 70 may be constructed with an indicator layer 80 which provides a visual indication of the milling bit 78 cutting through the side wall of scab portion 70. By way of example, the indicator layer 80 may be formed of rubber, epoxy, composite material, aluminum, copper, wood, or other suitable materials which provide an easy visual indication of the desired cutting as the cutting particles are circulated out of the wellbore 32. The indicator layer 80 also may be colored or coated with colors which further provide an easy visual indication of the cutting through scab portion 70.

Figure 11:
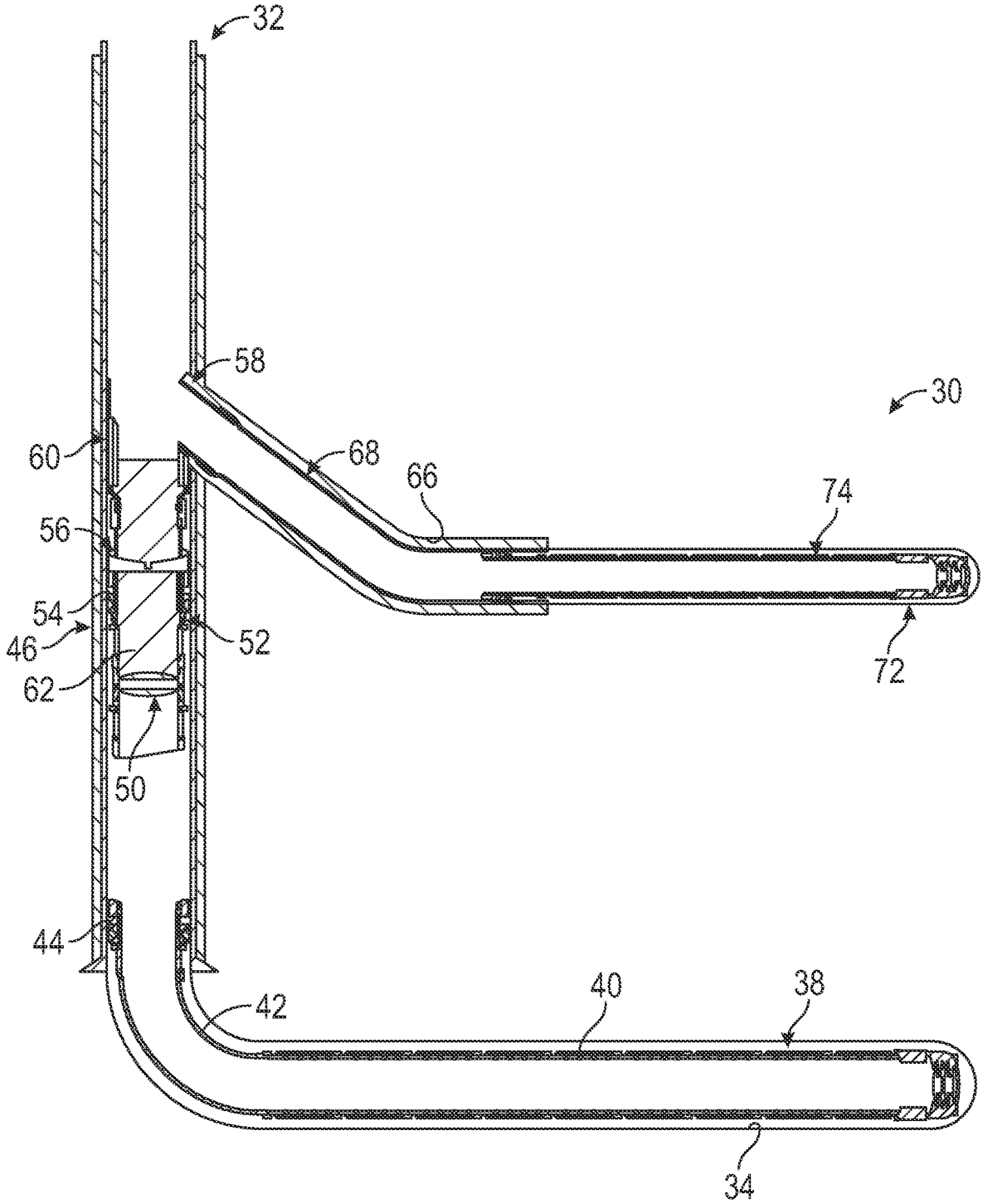
FIG. 11 is an illustration of an example of the well in which the scab portion of the liner has been removed, according to an embodiment of the disclosure.
Figure 12:
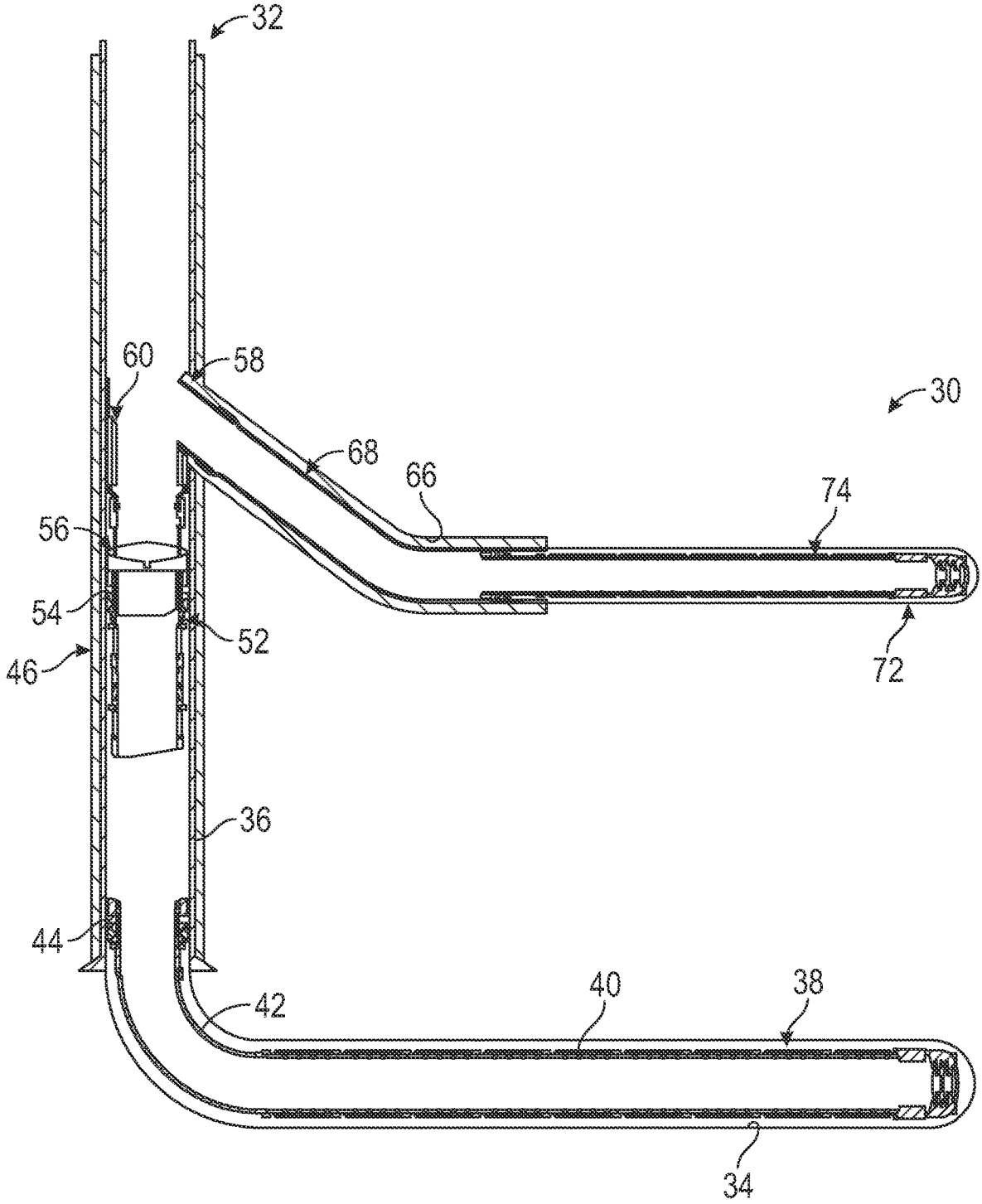
FIG. 12 is an illustration of an example of the well after the main wellbore has undergone a cleanout operation, according to an embodiment of the disclosure.

By removing scab portion 70, access is provided to the main wellbore 32 below lateral section 66, as illustrated in FIG. 11. At this stage, a cleanout procedure may be used to clean liner 68 and lateral window 58. The cleanout procedure also may be used to clean the main wellbore 32 and to remove the sand plug 62, as illustrated in FIG. 12. Subsequently, the removable disk 50 may be removed, e.g. fractured or milled, to enable fluid communication along the main wellbore 32 including along lower lateral section 34.

Figure 13:
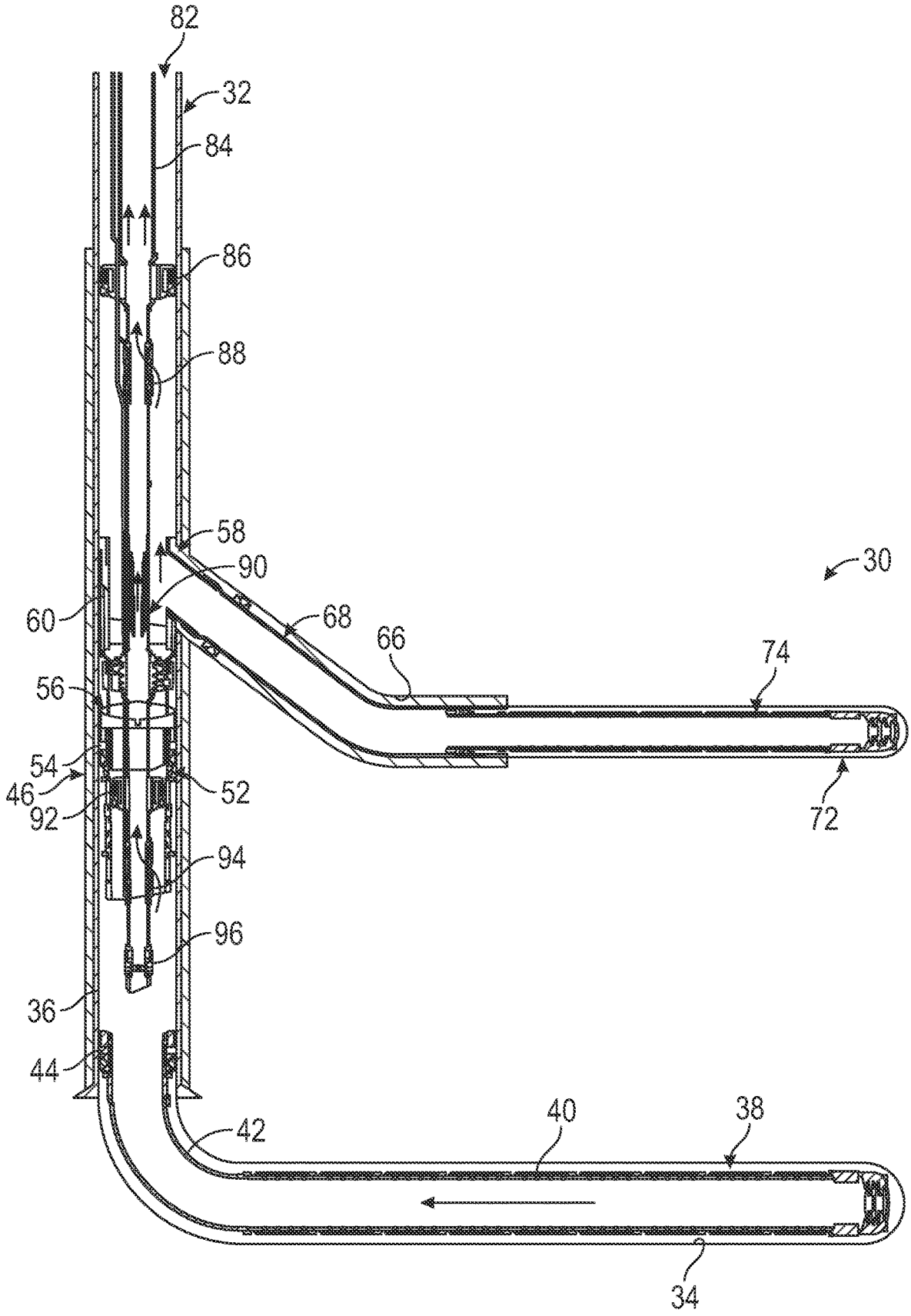
FIG. 13 is an illustration of an example of the well in which a smart completion has been deployed down into the main wellbore, according to an embodiment of the disclosure.

Following the cleanout procedure, a smart completion 82 may be deployed down through the main wellbore 32 and into engagement with, for example, tieback receptacle 56, as illustrated in FIG. 13. The smart completion 82 may be constructed and operated so as to control access and production with respect to both lower lateral section 34 and the lateral section 66. It should be noted that a single upper lateral section 66 is illustrated, but some well designs may utilize additional upper lateral sections 66. The smart completion 82 may comprise suitable features to facilitate locating the smart completion 82 and to help land and orient the system with respect to upper lateral section(s) 66.

The smart completion 82 may comprise a variety of components and constructions. In the example illustrated, however, the smart completion 82 is deployed via a tubing string 84 and comprises an upper feedthrough packer 86. Below the feedthrough packer 86, the completion 82 may comprise an upper annular flow control valve 88 which controls the flow of fluid, e.g. oil, from upper lateral section 66 to the interior of tubing string 84. The smart completion 82 also may comprise an isolator system 90 disposed proximate lateral window 58. The isolator system 90 may be constructed to provide mechanical access to the upper lateral section 66 while also enabling isolation of upper lateral section 66 and the fluid flows from upper lateral section 66.

In some embodiments, the smart completion 82 extends down through anchor 46 and may comprise additional components, such as an internal packer 92 and a lower flow control valve 94 which controls the flow of fluid, e.g. oil, from the lower lateral section 34 to the interior of tubing string 84. A mechanically controlled isolation valve 96 may be disposed at the lower end of tubing string 84. However, other flow blocking mechanisms, e.g. a nipple and plug assembly, may be used in place of the mechanically controlled isolation valve 96. Accordingly, the smart completion 82 may be used to control flow from lateral sections 34, 66 into the interior of tubing string 84 and ultimately to a desired collection location at the surface.

Figure 14:
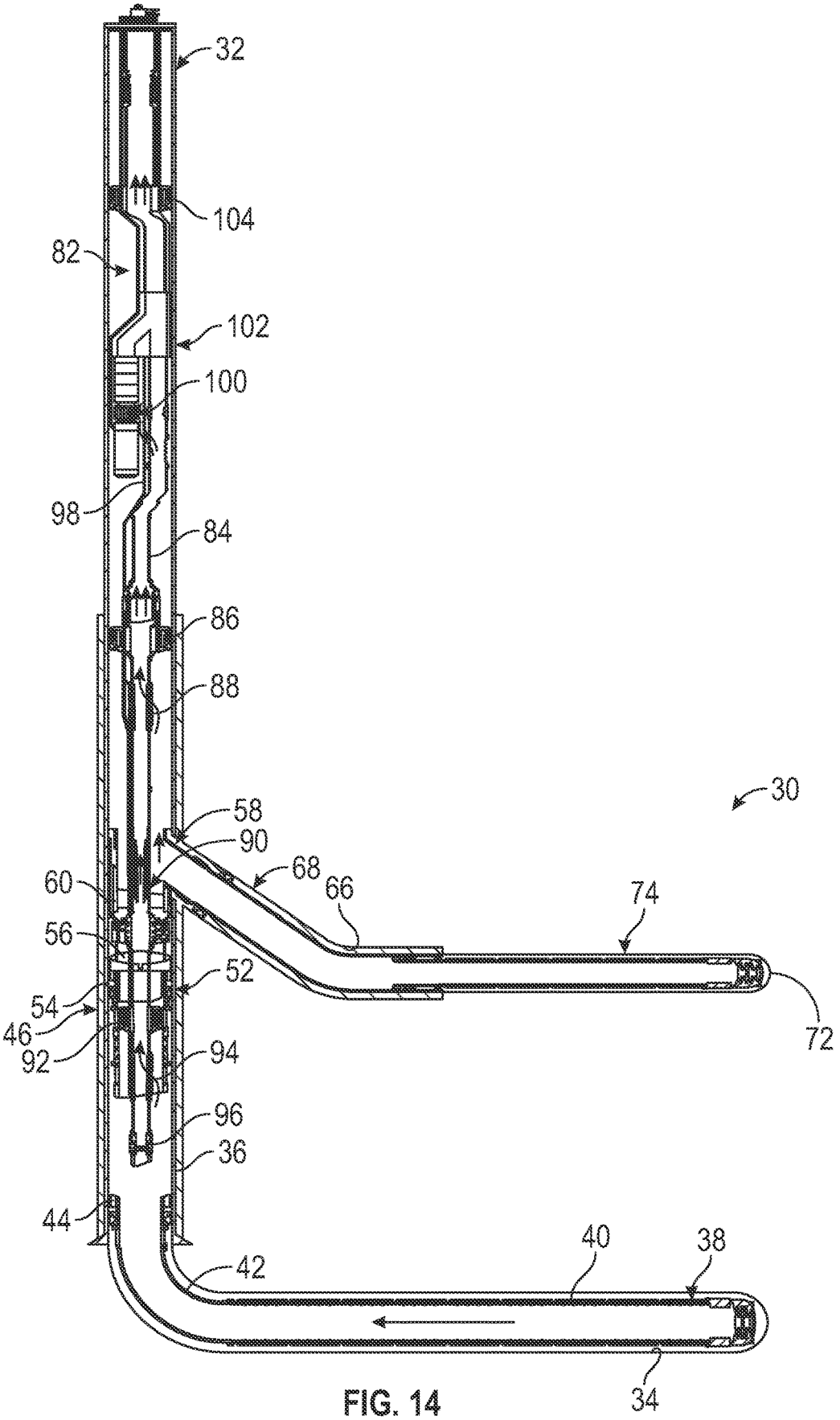
FIG. 14 is an illustration of an example of the well in which another embodiment of a smart completion has been deployed down into the main wellbore, according to an embodiment of the disclosure.

Referring generally to FIG. 14, another embodiment of smart completion 82 is illustrated. In this example, many of the components are similar to those illustrated and described with reference to FIG. 13 and have retained the same reference numerals. However, the embodiment illustrated in FIG. 14 directs the fluids flowing up through tubing string 84 to the exterior of tubing string 84 via a perforated joint 98. The fluids flow from perforated joint 98 into an electric submersible pumping system 100 which is operated to pump the fluids back into the tubing string 84 via, for example, a Y-block 102. The fluids may be pumped up through a pumping system packer 104 and directed through the tubing string 84 to a suitable collection location at the surface. This type of smart completion 82 also may be used to control flow from both lateral sections 34, 66 into tubing string 84 and ultimately to the desired collection location.

Figure 15:
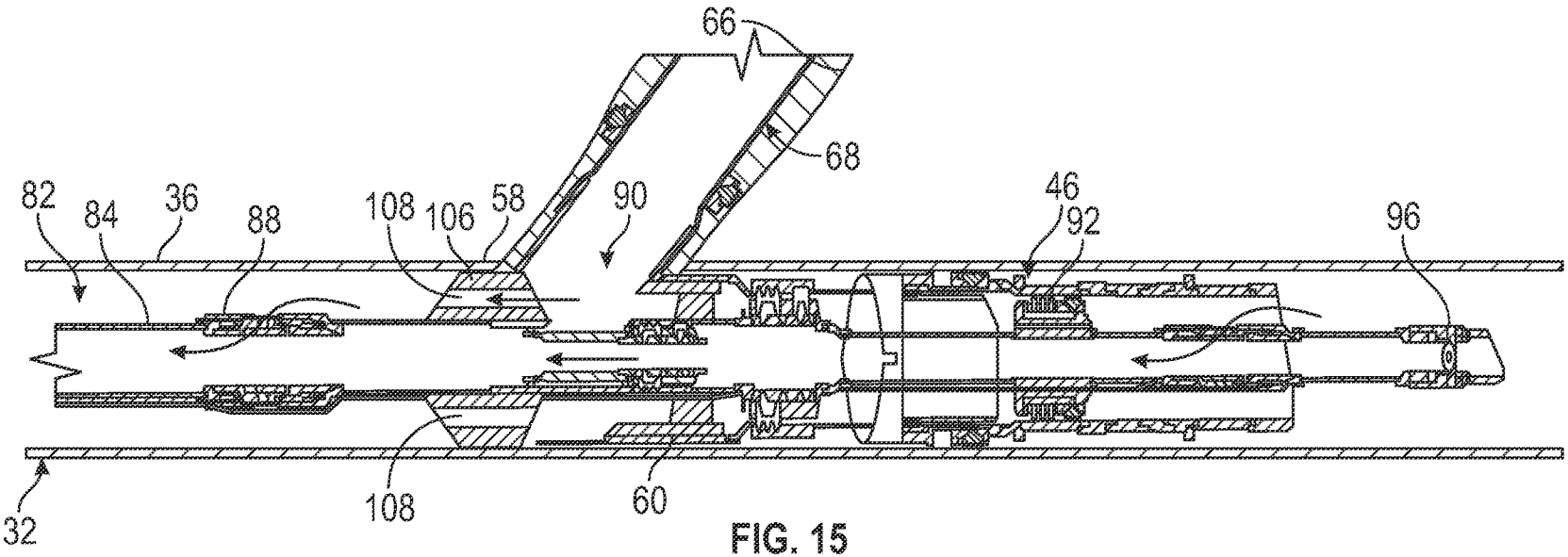
FIG. 15 is an illustration of an example of the well in which a completion has been constructed with an assembly to support the junction with the lateral section against collapse, according to an embodiment of the disclosure.
Figure 16:
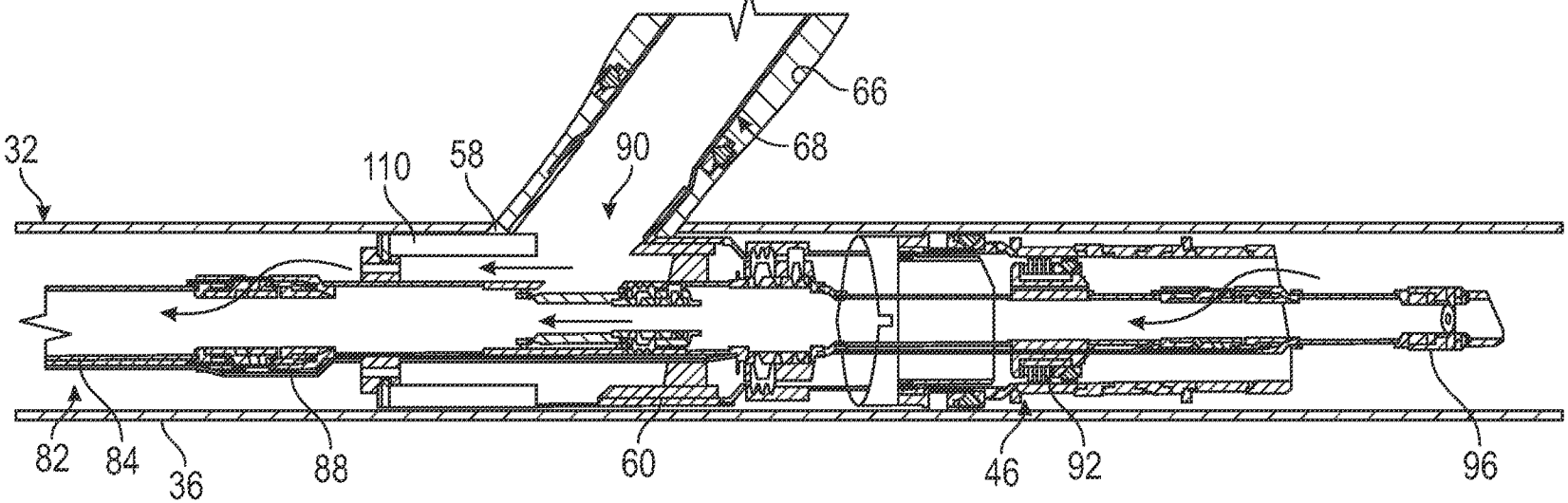
FIG. 16 is an illustration of an example of the well in which a completion has been constructed with another type of assembly to support the junction with the lateral section against collapse, according to an embodiment of the disclosure.

Isolator system 90 is generally referenced above to refer to the assembly of components which may be disposed proximate lateral window 58 so as to provide mechanical access and to enable desired fluid flows while providing support at this junction to prevent junction collapse. In FIGS. 15 and 16, embodiments of components that may be used in conjunction with or as part of the isolator system 90 are illustrated. According to the example illustrated in FIG. 15, a flow-through junction 106 is constructed with longitudinal openings 108 which allow flow of fluid from upper lateral section 66. However, the structure of the flow-through junction 106 provides support against junction collapse at lateral window 58.

Similarly, the embodiment illustrated in FIG. 16 uses a structure to provide support against junction collapse. In this example, however, the structure is provided by a flow-through shear sleeve 110. The flow-through shear sleeve 110 also is constructed to allow flow of fluid from upper lateral section 66 while providing support against junction collapse at lateral window 58. The flow-through shear sleeve 110 remains in position even when the smart completion 82 is pulled so as to continue preventing junction collapse.

Depending on the parameters of a given operation and the environment in which such operation is conducted, the lateral sections 34, 66 may be completed with a variety of systems and components. Similarly, the various devices and assemblies utilized in drilling, completing, and operating the well may be adjusted or changed. The smart completion 82 may comprise various structures, components, and features to achieve desired goals with respect to production from the well and life of the well.

Furthermore, the methodology described herein may be adjusted to accommodate specific parameters and goals or to accommodate equipment and systems utilized. For example, the liner 68 may be released as close as possible to the bottom of lateral window 58 before proceeding with a cementing operation. An open hole anchoring system may be employed just below the top of the liner 68 so the liner 68 does not move during the cementing operation. In various operations, excess cement may be cleaned from the interior diameter of the liner 68; from above the liner top; through the DPD 60; and through the interior of the liner running tool used to deploy liner 68. If the liner 68 does not bottom out, various techniques may be employed including reaming down with a full bore reaming shoe. If the liner 68 becomes stuck, a patch mechanism may be run downhole with a polished bore receptacle to enable recovery of the operations. These are just a few examples of alterations to the methodology which may be employed to finish a given well completion/production operation.

Similarly, the scab liner portion 70 may be a retrievable scab liner or a scab liner which may be cut away, e.g. milled. If the scab liner portion 70 is retrievable, it may comprise lower seals which are protected when running downhole into position. The seals may be oriented for landing into a tieback receptacle. Such a retrievable scab liner may be removed by, for example, a fishing tool. In various embodiments, the scab liner portion 70 may use a hanger/packer assembly which can be set hydraulically or by some other suitable technique. It should also be noted that in some embodiments, the technique may utilize running a lateral entry module which enables re-entry by latching such system into the DPD 60. If additional upper lateral sections 66 are to be employed in a given operation, the re-entry modules can be run when all the junctions are run or along the way as preferred. Again, these are just a few examples of alterations to the overall methodology described herein.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for use in a well, comprising:

completing a main wellbore;

running an anchor and a whipstock into the main wellbore;

milling a window along the main wellbore;

pulling the whipstock from the main wellbore;

running a production deflector into the main wellbore;

drilling a lateral section from the window;

running a liner down the main wellbore and out into the lateral section;

subsequently running an upper lateral sandface completion into the lateral section; and removing a scab portion of the liner, wherein removing the scab portion of the liner comprises milling the scab portion by utilizing ridges formed along an interior of the scab portion to engage a mill bit and to thus initiate the milling at a desired location along the scab portion.

2. The method as recited in claim 1, further comprising cementing the liner.

3. The method as recited in claim 1, wherein running the anchor and the whipstock comprises running a packer as part of the anchor.

4. The method as recited in claim 3, wherein running the anchor and the whipstock comprises running a hanger as part of the anchor.

5. The method as recited in claim 4, wherein running the anchor and the whipstock comprises running a ceramic disc as part of the anchor.

6. The method as recited in claim 4, wherein running the anchor and the whipstock comprises running a tieback receptacle as part of the anchor.

7. The method as recited in claim 3, further comprising:

after running the production deflector, circulating fluid to clean the packer.

8. The method as recited in claim 5, further comprising removing the ceramic disc.

9. The method as recited in claim 1, further comprising deploying a smart completion downhole to facilitate production from the main wellbore and the lateral section.

10. The method as recited in claim 1, further comprising forming the scab portion with a composite material to facilitate the milling during the milling of the scab portion.

11. The method as recited in claim 1, further comprising forming the scab portion from a steel material.

12. The method as recited in claim 1, further comprising forming the scab portion with an indicator layer.

13. A method, comprising:

completing a main wellbore;

running an anchor and a whipstock into the main wellbore;

cutting a window along the main wellbore;

pulling the whipstock from the main wellbore;

drilling a lateral section from the window;

running a liner down the main wellbore and out into the lateral section; and milling a scab portion of the liner, wherein the scab portion includes internal ridges formed along an interior of the scab portion to facilitate engagement of a milling bit during the milling of the scab portion.

14. The method as recited in claim 13, further comprising forming the scab portion with a composite material to facilitate the milling during the milling of the scab portion.

15. The method as recited in claim 13, further comprising forming the scab portion from a steel material.

16. The method as recited in claim 13, further comprising forming the scab portion with an indicator layer.

17. A method, comprising:

running a production deflector into a main wellbore;

drilling a lateral wellbore section from the main wellbore;

running a liner into the lateral wellbore section until a scab portion of the liner is disposed across the main wellbore at an angle; and removing the scab portion of the liner to provide communication with both the lateral wellbore section and the main wellbore below the lateral wellbore section, wherein removing the scab portion of the liner comprises milling the scab portion, wherein the scab portion includes a series of internal ridges formed along an interior of the scab portion oriented to catch a mill bit during the milling of the scab portion.

18. The method as recited in claim 17, further comprising forming the scab portion with a composite material to facilitate the milling during the milling of the scab portion.

19. The method as recited in claim 17, further comprising forming the scab portion from a steel material.

20. The method as recited in claim 17, further comprising forming the scab portion with an indicator layer.

* * * * *